US005168909A

United States Patent [19]

Joyner, Jr.

[11] Patent Number: 5,168,909

[45] Date of Patent: Dec. 8, 1992

[54] COMBINATION GOLF CLUB HEAD COVER AND HAND WARMER

[76] Inventor: George R. Joyner, Jr., 10 Hastings Valley, Durham, N.C. 27707

[21] Appl. No.: 681,915

[22] Filed: Apr. 8, 1991

[51] Int. Cl.[5] ..... A63B 57/00; A63B 71/14

[52] U.S. Cl. ..... 150/160; 2/17; 2/16; 15/227

[58] Field of Search ..... 150/159, 160; 206/315.2, 315.4; D21/221; 2/16, 17, 161 A; 15/227

[56] References Cited

U.S. PATENT DOCUMENTS

| | | | |
|---|---|---|---|
| D. 279,999 | 8/1985 | Menath | D21/221 |
| 2,526,985 | 10/1950 | Whitehead | 150/160 |
| 2,737,394 | 3/1956 | Abel | 150/160 X |
| 3,203,005 | 8/1965 | Burrows | 2/17 X |
| 3,253,627 | 5/1966 | Koetting | 150/160 |
| 3,397,891 | 8/1968 | Koch | 2/17 X |
| 3,406,419 | 10/1968 | Young | 150/160 X |
| 4,368,768 | 1/1983 | Cunko, Jr. | 150/160 |
| 4,564,956 | 1/1986 | DiBuono | 2/16 |
| 4,699,164 | 10/1987 | Pilney et al. | 150/160 X |

*Primary Examiner*—Sue A. Weaver
*Attorney, Agent, or Firm*—John G. Mills

[57] ABSTRACT

This invention is a combination golf club head cover and hand warmer. The head cover stays on the head of the golf club to protect the same except when the club is being used. In the present case, the cover fits on the longest club which is the one the golfers traditionally rest their hand on when carrying their clubs in a golf bag. During cold weather the hand of the golfer can be slipped into the handwarming pocket or pouch to eliminate the need for taking gloves or mittens on and off during play while at the same time keeping the hand warm and ready to play.

8 Claims, 3 Drawing Sheets

COMBINATION GOLF CLUB HEAD COVER AND HAND WARMER

FIELD OF INVENTION

This invention relates to the game of golf and more particularly to a means to protect the head of a golf club which is at all times kept on the same except when it is being used to drive the ball. At the same time, such means is adapted to keep the hand of the player warm in cold weather.

BACKGROUND OF INVENTION

More and more golfers are carrying their golf clubs in golfbags to enable them to get exercise rather than hiring a caddy to carry the bag or riding in a golf cart. During cold weather the golfer's hands must be kept warm or such golfer will not be able to properly grip his clubs which, of course, would adversely affect his game.

The wearing of gloves usually does not work very well with golfers since they concentrate so much on their game, particularly their driving game, that they invariably leave the gloves on the ground next to the tee or other location where they are playing. Also wearing light gloves in cold weather does not keep the golfer's hands warm enough and warm bulky gloves cause the problem of what to do with them during play.

DISCUSSION OF PRIOR ART

A search of the prior art disclosed U.S. Pat. No. 4,564,956 to DiBuono, Pat. No. 3,397,891 to Koch and 3,203,005 to Burrows which relate to a golf club with rain shield, a dry-grip sleeve, and a two-handed mitten, respectively, used in conjunction with golf clubs during play. These patents were not concerned with keeping the hand of the golfer warm while carrying his golf clubs in his golf bag from one area of play to the next.

Pat. No. 4,488,313 to Delaney discloses a ski glove which can be strapped and left on a ski pole and is designed to help keep the hands of the skier warm. The structure of the ski glove is different from applicant's invention, has a different purpose, and certainly would not function as a combination golf club head cover and hand warmer.

BRIEF DESCRIPTION OF INVENTION

After much research and study into the above mentioned problems, the present invention has been developed to provide a means for keeping the hand of the golfer warm that is rested on the longest driver in the golf bag to steady such bag while walking.

The above is accomplished through the provision of a more or less standard protective head cover with an integral pocket or pouch for the hand of the golfer to slip into. This not only eliminates the wind chill factor on the bare hand, but it also keeps the hand as warm as the other hand which is kept warm in the pocket of the clothing of the golfer.

During warmer weather when the handwarming pocket is not needed, a hook and loop fastening means such as Velcro or other suitable connecting means can be used to collapse such pocket to almost the same size and shape as a normal protective golfclub head cover. When the weather turns cooler, the connecting means is simply released to provide access to the hand warming pocket portion of the present invention.

OBJECTS OF INVENTION

In view of the above, it is an object of the present invention to provide a combination golf club head cover and hand warmer.

Another object of the present invention is to provide a protective golf club head cover with an integral, pouch-like pocket for keeping the hand of the golfer warm when it rests on a golf club to steady the same in the golf bag.

Another object of the present invention is to provide a combination golf club head cover and hand warmer which, when not in use as a hand warmer, can be collapsed to the same basic size and shape as a standard head cover.

Another object of the present invention is to provide a simple, relatively inexpensive, and yet highly efficient means for protecting the head of a golf club and keeping one of the hands of a golfer warm.

Another object of the present invention is to provide a means for eliminating the necessity of a golfer wearing gloves or mittens while playing in cool or cold weather.

Another object of the present invention is to provide a means for keeping one hand of a golfer warm by combining such means with a second means that a golfer is not likely to put down and misplace or lose.

Other objects and advantages of the present invention will become apparent and obvious from a study of the following description and the accompanying drawings which are merely illustrative of such invention.

DETAILED DESCRIPTION OF INVENTION

Figure 1:
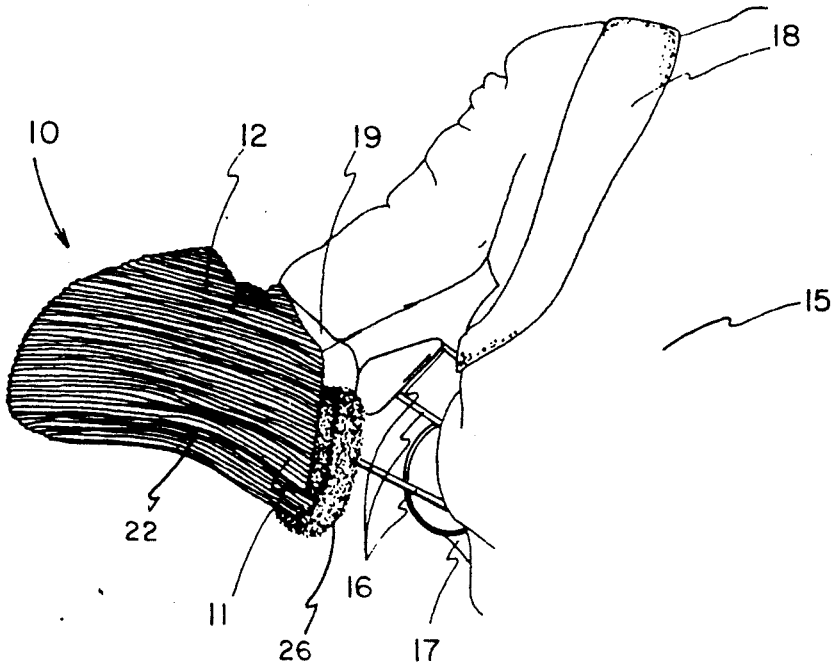
FIG. 1 is a perspective view of the combination golf club head cover and hand warmer in use.
Figure 2:
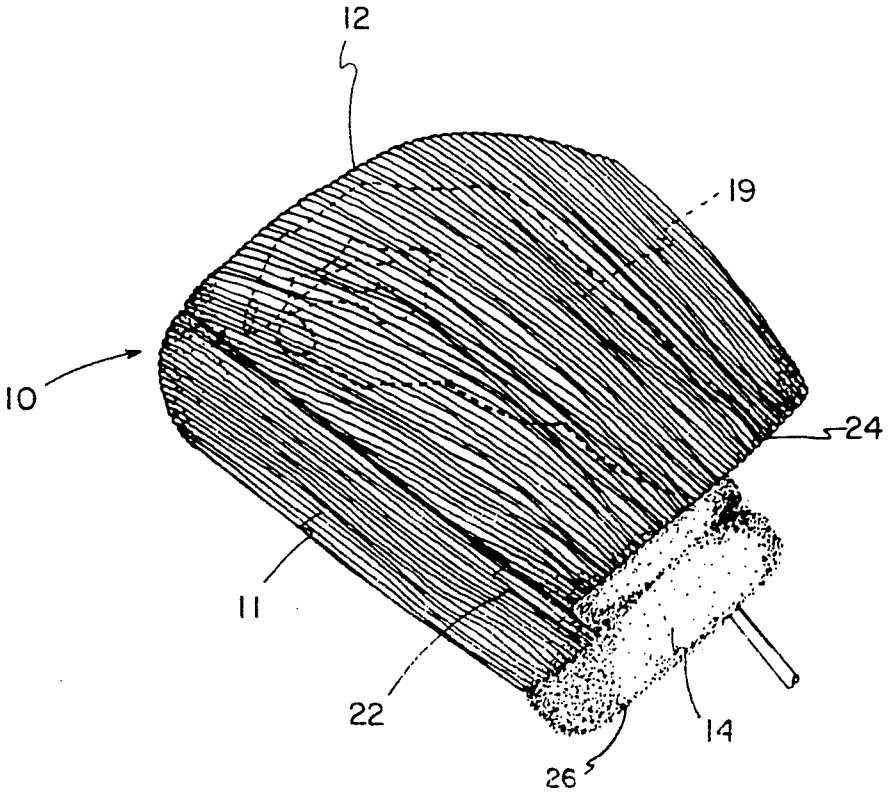
FIG. 2 is an enlarged view showing the location of the player's hand in the hand warmer portion of the present invention.
Figure 3:
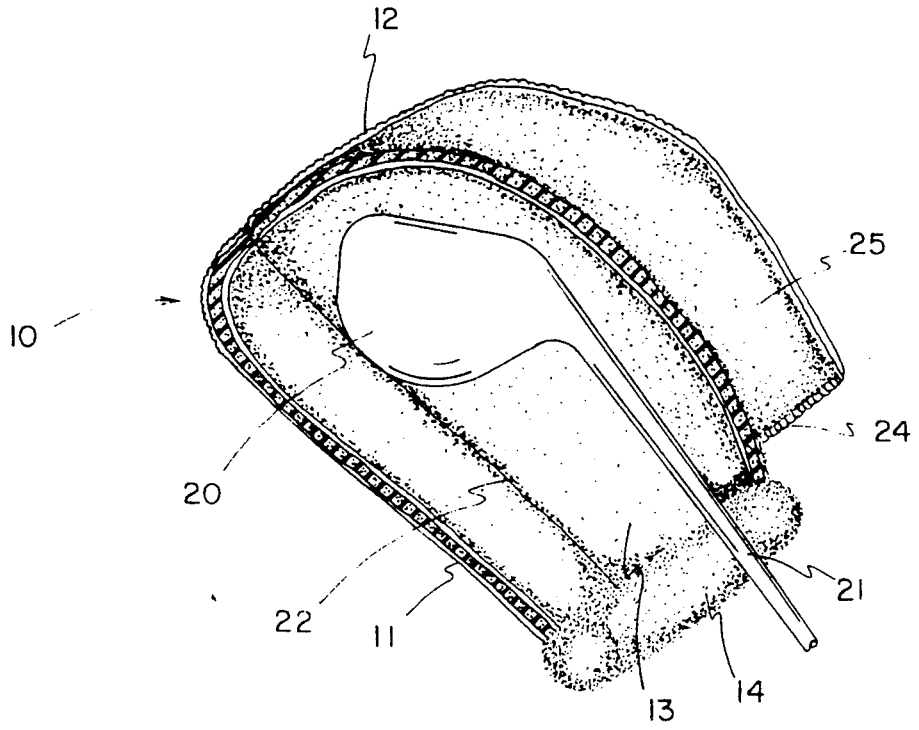
FIG. 3 is a longitudinal, sectional view showing the interior of both the hand warmer and club head cavities.
Figure 4:
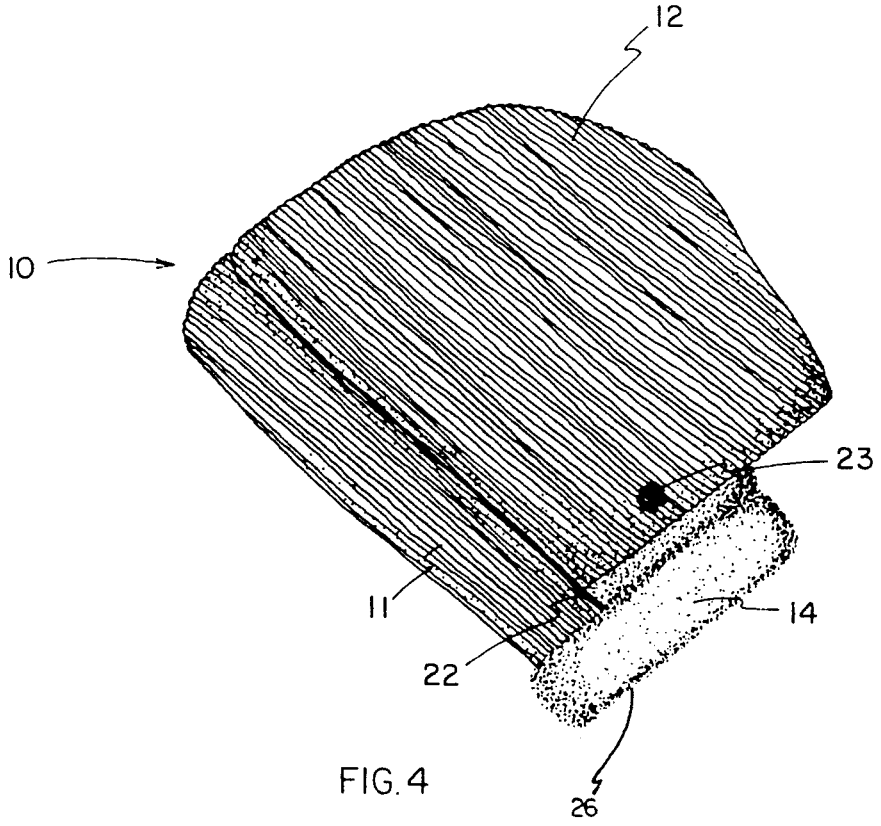
FIG. 4 is a side elevational view of the present invention.
Figure 5:
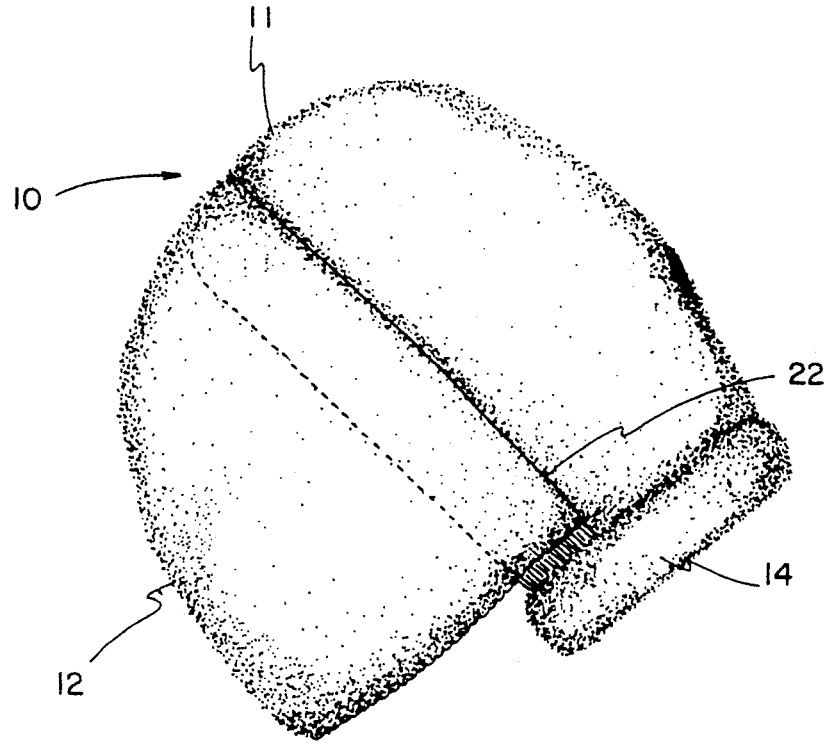
FIG. 5 is a side elevational view of the present invention turned wrong side out.

With further reference to the drawings, the combination golf club head cover and hand warmer, indicated generally at 10, includes a more or less standard golf club head cover portion 11 and a pocket-like hand warmer portion 12. The head cover portion 11 can be made from any suitable material, but a warm, fibrous or fuzzy material appears to be better since it retains heat more readily than smooth, uninsulated materials.

The head cover portion 11 includes an internal cavity 13 with an elastic or other suitable size reducing means 14 to form the mouth of such cavity.

Golfers 15 who prefer carrying their golf clubs 16 in a golf bag 17 with such golf bag supported by a shoulder strap 18 will usually rest their hand 19 on the head 20 of the longest driver or 3 wood 21. This not only acts as a hand rest, but enables the hand and arm of the golfer to balance the bag while carrying the clubs and prevents such bag from swinging from side to side.

The combination head cover and hand warmer of the present invention 10 is so sized as to slip over the head 20 of driver 21 so that such head is disposed within internal cavity 13. Either elastic or other suitable means 14 is used to prevent the combination cover and warmer of the present invention from inadvertently slipping off of the head 20 of driver 21.

The pouch-like portion 12 of the present invention 10 is integrally secured to the head cover portion 11 by suitable means such as being sewn into seam 22 of said cover portion. This seam extends from the mouth area 26 thereof, around the end, and back to said mouth area. Other suitable means for securing these two portions together can, of course, be used.

The pouch-like hand warmer portion 12 is preferably formed from a warm, fuzzy-like material to retain heat when the hand 19 of the golfer 15 is inserted there into.

A patch of a hook and loop fastening means 23 such as Velcro, or a snap, or other securing means is provided on the outside of the pouch portion 12 in spaced relation from where such pouch joins the head cover portion. This securing means is also adjacent the entrance edge 24 of the hand warming cavity 25.

The purpose of securing means 23 is to allow the pouch portion 12 of the present invention to be pulled down juxtaposed to the head cover portion 11 during warmer weather when the hand warmer is not needed. This is shown clearly in FIG. 6. When in this configuration, the combination head cover and hand warmer has the feel and appearance of nothing more than a standard golf club head cover.

To use the combination head cover and hand warmer of the present invention, the head cover portion 11 is slipped over the head 20 of driver 21 in the normal manner of placing a golf club head cover protector on a golf club head. The club 21 is placed in the golf bag 17 and the shoulder strap 18 is slung over the shoulder of the golfer 15.

If it is cold weather golfer 15 will insert his hand 19 into the hand warming cavity 25 and rest such hand on the cover portion 11 above the head 20 of driver 21.

The golfer can then walk to the tee while keeping his golf club balancing hand warm with his other hand being placed in any convenient pocket of his clothes.

Once on the tee, the golfer removes the cover portion 11 of the present invention 10 from the driver 21 and proceeds to tee off.

The golfer then replaces the driver 21 in his golf bag 17, replaces the cover portion 11 over the golf club head 20, places his hand back into the hand warming cavity 25, and walks to the location of his ball where the next play takes place.

By using the combination 10 of the present invention, the golfer does not have to put on and take off mittens or gloves each time he drives or putts, his balancing hand staying warm in cavity 25 and his other hand staying warm in his pocket. There is nothing extra to keep up with since head covers for expensive drivers are standard golfing equipment.

Figure 6:
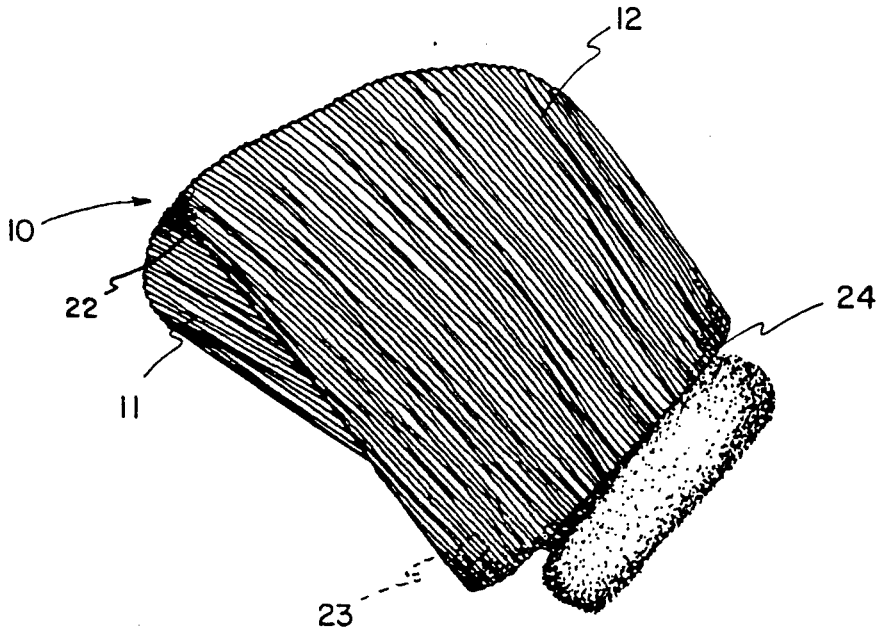
FIG. 6 is a side elevational view of the present invention in folded, secured warm weather position.

During warmer weather or during storage, the area of the hand warmer pouch 12 adjacent where it is connected to the head cover portion 11 can be simply folded in and then pulled down around the cover portion. The pouch then conforms to the shape of the head cover when it is secured as illustrated in FIG. 6. In other words the pouch portion lays juxtaposed to and generally follows the contour to the cover portion 11 to give a simple, neat head cover appearance.

From the above it can be seen that the present invention provides a means for keeping the hand of the golfer warm that is used to balance the golf bag while walking between golf shots. This eliminates the necessity of wearing of gloves, mittens or other suitable clothing.

The present invention may of course be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A combination golf club head cover and hand warmer comprising: an elongated, sleeve-like cover portion forming a cavity that is open at one end and of sufficient size to fit over and receive therein the had and part of the shaft of a golf club; and a pouch-like hand warmer portion secured by attachment means to said cover portion and having a defined opening disposed generally in the same direction as said open end of said cover portion and of sufficient size to fit over and receive therein the hand of a golfer whereby said cover portion will protect the head and a portion of the shaft of a golf club while the pouch-like hand warmer portion will keep the hand of the golfer warmer during colder weather.

2. The combination of claim 1 wherein a means is provided for constricting the open end of said cover portion whereby said cover portion will more readily remain on said golf club head and shaft once it is mounted.

3. The combination of claim 2 wherein said constricting means is at least partially an elastomer means.

4. The combination of claim 3 wherein said elastomer means is an elastic material.

5. The combination of claim 1 wherein the exterior of said cover portion and the interior of said hand warmer portion are constructed of a fleece-like material.

6. The combination of claim 1 wherein a securing means is provided on said pouch-like hand warmer portion whereby when said pouch is into being used as a hand warmer, the same can be folded down juxtaposed to said cover portion and secured in such position.

7. The combination of claim 6 wherein aid securing mean is a hook and loop fastening means.

8. A combination golf club head cover and hand warmer comprising: an elongated, sleeve-like cover portion having opposite side with outside surfaces forming a cavity that is open at one end and of sufficient size to fit over and receive therein the head and a portion of the shaft of a golf club; and a pouch-like hand warmer portion secured by attachment means to said cover portion longitudinally on said outside surfaces of the opposite sides of said cover portion and having an opening disposed generally in the same direction as said open end of said cover portion and of sufficient size to fit over and receive therein the hand of a golfer whereby the head and a portion of the shaft of a golf club can be protected while the hand of the golfer can rest on such club and be kept warm.

* * * * *

UNITED STATES PATENT AND TRADEMARK OFFICE

CERTIFICATE OF CORRECTION

PATENT NO. : 5,168,909

DATED : December 8, 1992

INVENTOR(S) : George R. Joyner, Jr.

It is certified that error appears in the above-indentified patent and that said Letters Patent is hereby corrected as shown below:

Column 4, Line 20, change "had" to --head--.

Column 4, Line 45, change "into" to --not--.

Signed and Sealed this

Twenty-sixth Day of October, 1993

*Attest:*

Bruce Lehman

BRUCE LEHMAN

*Attesting Officer*

*Commissioner of Patents and Trademarks*